US005759305A

United States Patent [19]

Benz et al.

[11] Patent Number: 5,759,305

[45] Date of Patent: Jun. 2, 1998

[54] GRAIN SIZE CONTROL IN NICKEL BASE SUPERALLOYS

[75] Inventors: Mark Gilbert Benz, Burnt Hills, N.Y.; Edward Lee Raymond, Maineville, Ohio; Robert Donald Kissinger, Montgomery, Ohio; Eric Scott Huron, West Chester, Ohio; Charles Philip Blankenship, Jr.; Michael Francis Henry, both of Niskayuna, N.Y.

[73] Assignee: General Electric Company, Schenectady, N.Y.

[21] Appl. No.: 598,452

[22] Filed: Feb. 7, 1996

[51] Int. Cl.[6] ..... C21D 8/00; B22F 3/24

[52] U.S. Cl. ..... 148/514; 148/677; 148/676; 419/28; 419/41; 419/67; 72/356; 72/700; 72/709

[58] Field of Search ..... 148/514, 676, 148/677, 556; 419/28, 29, 67, 41, 42, 47; 72/356, 352, 700, 709

[56] References Cited

U.S. PATENT DOCUMENTS

| | | | |
|---|---|---|---|
| 4,612,062 | 9/1986 | Nazmy et al. . | |
| 4,685,977 | 8/1987 | Chang | 148/677 |
| 5,061,324 | 10/1991 | Chang . | |
| 5,143,563 | 9/1992 | Krueger et al. | 148/410 |
| 5,413,752 | 5/1995 | Kissinger et al. | 419/28 |
| 5,529,643 | 6/1996 | Yoon et al. | 148/514 |
| 5,547,523 | 8/1996 | Blankenship et al. | 148/677 |

FOREIGN PATENT DOCUMENTS

| | | |
|---|---|---|
| 2225790 | 6/1990 | United Kingdom . |
| 9413849 | 6/1994 | WIPO . |

OTHER PUBLICATIONS

Metals Handbook, 9th ed, vol. 14 "Isothermal and Hot Die Forging" pp. 150–157, 1988. TA 459 M 143 in STIC.

*Primary Examiner*—Margery Phipps

*Attorney, Agent, or Firm*—Ernest G. Cusick; William H. Pittman

[57] ABSTRACT

A method for forming nickel base superalloy articles of manufacture by a combination of hot die forging, isothermal forging and heat treatment below and above the solvus.

15 Claims, No Drawings

GRAIN SIZE CONTROL IN NICKEL BASE SUPERALLOYS

FIELD OF THE INVENTION

This invention is generally directed to nickel base superalloys and to articles fabricated of such alloys and particularly to the microstructure of such articles. In a particular aspect the invention provides a method of article fabrication which includes hot die forging a γ nickel base superalloy preform and controlling grain size and distribution of the γ' phase.

BACKGROUND OF THE INVENTION

The performance requirements for gas turbine engines are continually being increased to improve engine efficiency, necessitating higher internal operating temperatures. Thus, the maximum operating temperatures of the materials used for components in these engines, particularly turbine rotor components such as turbine disks, continue to rise. Components formed from powder metal strengthened γ' Ni-base superalloys provide a good balance of creep, tensile and fatigue crack growth properties to meet these performance requirements. Typically, strengthened γ' Ni-base superalloys are produced by consolidation of superalloy powders, using methods such as hot isostatic pressing and extrusion consolidation. These consolidated superalloys are used to make various forging preforms. Such preforms are then isothermally forged into finished or partially finished forms, and finally heat treated above the γ' solvus temperature to control the grain size and γ' distribution. Methods for consolidation of superalloys powders and the creation of preforms are well known.

With respect to γ' strengthened Ni-base superalloys, isothermal forging is a term which describes a well-known forging process carried out at slow strain rates (e.g. typically less than 0.01 $s^{-1}$) and temperatures slightly below the γ' solvus temperature e.g. 50° to 100F.°, but above the recrystallization temperature of the particular superalloy. These processing parameters are chosen to encourage superplastic deformation. Isothermal forging requires expensive tooling, an inert environment, and slow ram speeds for successful operation. At the end of an isothermal forging operation, no substantial increase in dislocation density should be observed, as strain is accommodated by grain boundary sliding and diffusional processes. In the event that dislocations are generated, the high temperatures and slow stroke rates allow dynamic recovery to occur. Thus, this forging method is intended to minimize retained metallurgical strain at the conclusion of the forming operations. Isothermal forging is known to produce a uniform, fine average grain size, typically on the order of ASTM 12-14 (3–5 μm). Reference throughout to ASTM intercept or ALA grain sizes is in accordance with methods E112 and E930 developed by the American Society for Testing and Materials, rounded to the nearest whole number. For applications that demand enhanced creep and time dependent fatigue crack propagation resistance, coarser grain sizes of about ASTM 6-8 (20–40 μm) are required. These coarser grain sizes are currently achieved in isothermally forged superalloys by heat treating above the γ' solvus, but below the incipient melting temperature of the alloy. After isothermal forging and supersolvus heat treatment, cooling and aging operations are also frequently utilized to control the γ' distribution.

While isothermal forging tends to produce a ASTM 12-14 (3–5 μm) average grain size, subsequent supersolvus annealing causes the average grain size to increase in a relatively step-wise fashion to about ASTM 6-8 (20–40 μm). Thus, it is generally not possible to control the average grain size over the entire range of sizes between about ASTM 6–14 (3–40 μm) using a single forging method, which control may be very desirable to achieve particular combinations of alloy properties, particularly mechanical properties. Isothermal forging processes are relatively slow forming processes compared to other well-known forging processes, such as hot die or hammer forging processes, due to the slow strain rates employed. Isothermal forging typically requires more complex forging equipment due to the need to accurately control slow strain rate forging. It also requires the use of an inert forging environment, and it is also know to be difficult to maintain thermal stability in many isothermal forges. Therefore, components formed by isothermal forging are generally more costly than those formed by other forging methods.

Unless isothermal forging processes are very carefully controlled, it is possible to impart retained strain into the forged articles, which can in turn result in critical grain growth during subsequent heat treatment operations. Complex contoured forgings contain a range of localized strains and strain rates. If forging temperatures are too low, or local strain rates are too high, diffusional processes that prevent strain energy from being stored in the microstructure cannot keep up with the imposed strain rate. In such cases, dislocations are generated causing strain energy to be retained within the microstructure. The term "retained strain" refers to the dislocation density, or metallurgical strain present in the microstructure of a particular alloy. When working a superalloy at temperatures that are less than the alloy recrystallization temperature, the amount of retained strain is directly related to the amount of geometric strain because diffusional recovery processes in the alloy microstructure occur very slowly at these temperatures. However, the amount of retained strain that occurs in a superalloy microstructure that is worked at temperatures that are above the recrystallization temperature is more directly related to the temperature and strain rate at which the deformation is done than the amount of geometric strain. Higher working temperatures and slower strain rates result in lower amounts of retained strain.

When Ni-base superalloys that contain retained strain are subsequently heat treated above the γ' solvus, critical grain growth may occur, wherein the retained strain energy in the article is sufficient to cause limited nucleation and substantial growth in regions containing the retained strain of very large grains, resulting in a bimodal grain size distribution. Critical grain growth is defined as localized abnormal excessive grain growth to grain diameters exceeding the desired range, which is generally up to about ASTM 2 (180 μm) for articles formed from consolidated powder metal alloys. Critical grain growth can cause the formation of grain sizes between about 300–3000 microns. Factors in addition to dislocation density and retained strain, such as the carbon, boron and nitrogen content, and subsolvus annealing time, also appear to influence the grain size distribution when critical grain growth occurs. Critical grain growth may detrimentally affect mechanical properties such as tensile strength and fatigue resistance.

Critical grain growth is thought to result from nucleation limited recrystallization followed by grain growth until the strain free grains impinge on one another. The resulting microstructure has the bimodal distribution of grain sizes noted above. Critical grain growth occurs over a relatively narrow range of retained strain. Slightly higher retained strain results in a higher nucleation density and a finer and more homogeneous resultant grain size. Slightly lower retained strain is insufficient to trigger the recrystallization process. Thus, the term critical grain growth was adopted to describe the observation that a critical amount or range of retained strain was required to lead to this undesirable microstructure.

Critical grain growth is not observed in Ni-base superalloys containing a high volume fraction of γ' until heat treatment is performed above the γ' solvus. It is therefore noted that, in this complicated alloy system, factors in addition to retained strain influence grain structure evolution. Particles that pin grain boundaries play an active role in controlling grain size, most notably, the coherent, high volume fraction γ' phase.

However, it is desirable to develop additional forging methods for these Ni-base superalloys, particularly methods that facilitate material handling and permit more control over the grain size of the microstructure in the range of ASTM 5-14 (3–60 μm) than present forging methods.

SUMMARY OF THE INVENTION

It has been discovered that at least some of the prefinish forging operations can be carried out using working conditions that are in the hot-die forging regime. This allows the use of faster strain rates and reduces the need for extensive isothermal forging. Isothermal working can be limited to the final filling operation to insure that superplastic deformation occurs and that the complete filling of a complex die shape without cracking of the forged article.

In general, the process of this invention comprises application of hot die forging initial forging (upset) operations and isothermal forging in subsequent operations. Unexpectedly, it was found that hot die forging for the initial upset and then followed with isothermal forging and, if necessary, subsolvus annealing to provide a microstructure suitable for supersolvus heat treatment to produce a uniform grain size of about 6–8. Hot die forging has been found to cause partial or complete recrystallization of the microstructure to be ready for superplastic deformation in the subsequent isothermal forging operations. This process is particularly applicable to forging of large complex shaped articles. This invention comprises forging fine-grained Ni-base superalloy preforms followed by subsolvus annealing of the forged article at a temperature which is above the recrystallization temperature, but below the γ' solvus temperature, in order to completely recrystallize the worked article and produce a uniform, fine grain size microstructure. The retained strain energy imparted should be sufficient to cause essentially complete recrystallization and the development of a uniform recrystallized grain size. The subsolvus annealing is preferably followed by supersolvus annealing to coarsen the grain size and redistribute the γ' precipitate. After either the subsolvus annealing or supersolvus annealing steps, controlled cooling of the article to a temperature below γ' solvus temperature may be employed to control the distribution of the γ'. The method may be used to control the average grain size of an article forged according to the method within a range of about ASTM 5-12 (5–60 μm), as well as controlling the distribution of γ' within the alloy microstructure.

The method may be briefly and generally described as comprising the steps of: providing a Ni-base superalloy having a recrystallization temperature, a γ' solvus temperature, and a microstructure comprising a mixture of γ and γ' phases, wherein the γ' phase occupies at least 30% by volume of the Ni-base superalloy; hot die forging the superalloy at preselected working conditions, finish forging isothermally and subsolvus annealing for a time sufficient to cause recrystallization of a uniform grain size throughout the article; and cooling the article from the subsolvus annealing temperature at a predetermined rate in order to cause the precipitation of γ', heat treating the article to coarsen the grains.

DESCRIPTION OF THE INVENTION

The invention provides two general embodiments for hot die forging and subsequent working and heat treatments. In one embodiment, the preform is initially hot die upset followed by isothermal forging and supersolvus heat treatment produces a uniform grain size (ASTM 6-8) microstructure. In another embodiment, after the initial hot die working the work piece is annealed below the γ' solvus, isothermally finish forged and then given a supersolvus heat treatment. TEM of the subsolvus annealed specimens indicates that the highly deformed microstructure recrystallizes below the γ' solvus and develops a fine grain superplastic microstructure.

Schematic representations of suggested treatment schedules are shown below.

1. hot die upset+isothermal prefinish+isothermal finish+supersolvus heat treatment.

2. hot die upset+hot die prefinish+isothermal finish+subsolvus anneal+supersolvus heat treatment.

3. hot die upset+hot die prefinish+subsolvus-anneal+isothermal finish+supersolvus heat treatment.

The process begins with the step of providing a Ni-base superalloy containing a relatively large volume fraction of γ', usually in the form of a P/M forging preform. A forging preform may be of any desired size or shape that serves as a suitable preform, so long as it possesses characteristics that are compatible with being formed into a forged article. The preform may be formed by any number of well-known techniques, however, the finished forging preform should have a relatively fine grain size within the range of about 1–50 μm. A forging preform can be provided by hot-extrusion of a precipitation strengthened γ' Ni-base superalloy powder using well-known methods, such as by extruding the powder at a temperature sufficient to consolidate the particular alloy powder into a billet, blank die compacting the billet into a desired shape and size, and then hot-extruding to form the forging preform. Preforms formed by hot-extrusion generally have an average grain size on the order of ASTM 12-16 (1–5 μm). Another method for forming preforms may comprise the use of spray-forming, since articles formed in this manner also characteristically have a grain size on the order of about ASTM 5.3-8 (20–50 μm). The provision of forging preforms in the shapes and sizes necessary for forging into finished or semifinished articles is well known, and described briefly herein. However, the method of the present invention does not require that the Ni-base superalloy be provided as a forging preform. It is sufficient as a first step of the method of the present invention to merely provide a Ni-base superalloy preform having the characteristics described above that is adapted to receive some form of a working operation sufficient to introduce the necessary retained strain. Also, the forging preform may comprise an article that has been previously worked, such as by isothermal forging, or other forming or forging methods.

The method of this invention can be applied generally to Ni-base superalloys comprising a mixture of γ and γ' phases. However, references such as U.S. Pat. No. 4,957,567 suggest that the minimum content of γ' should be about 30 percent by volume at ambient temperature. Such Ni-base superalloys are well-known. Representative examples of these alloys, including compositional and mechanical property data, may be found in references such as Metals Handbook (Tenth Edition), Volume 1 Properties and Selection: Irons, Steels and High-Performance Alloys, ASM International (1990), pp. 950–1006. The method of the present invention is particularly applicable and preferred for use with Ni-base superalloys that have a microstructure comprising a mixture of both γ and γ' phases where the amount of the γ' phase present at ambient temperature is about 40 percent or more by volume. These alloys typically have a microstructure comprising γ phase grains, with a distribution of γ' particles both within the grains and at the grain boundaries, where some of the particles typically form a serrated morphology that extends into the γ grains. The distribution of the γ' phase depending largely on the thermal processing of the alloy. Table 1 below shows a representative group of Ni-base superalloys for which the method of the present invention may be used and their compositions in weight percent. These alloys may be described very generally as alloys having compositions in weight percent in the range 8–15 Co, 10–19.5 Cr, 3–5.25 Mo, 0–4 W, 1.4–5.5 Al, 2.5–5 Ti, 0–3.5 Nb, 0–3.5 Fe, 0–1 Y, 0–0.07 Zr, 0.04–0.18 C, 0.006–0.03 B and a balance of Ni, and excepting incidental impurities. Applicants further believe that this may include Ni-base superalloys that also include small amounts of other phases, such as the δ or Laves phase. The Ni-base superalloys described herein have a recrystallization temperature, a γ' solvus temperature and an incipient melting temperature. The recrystallization temperature for the alloys range roughly from 1900° to 2000° F., depending on the nature and concentrations of the varying alloy constituents. The γ' solvus temperatures for these alloys typically range from about 1900° to 2100° F. The incipient melting temperatures of these alloys are typically less than about 200° F. above their γ' solvus temperatures.

TABLE I

| Element | Rene'88 | Rene'95 | Alloy IN-100 | U720 | Waspaloy | Astroloy |
|---|---|---|---|---|---|---|
| Co | 13 | 8 | 15 | 14.7 | 13.5 | 15 |
| Cr | 16 | 14 | 10 | 18 | 19.5 | 15 |
| Mo | 4 | 3.5 | 3 | 3 | 4.3 | 5.25 |
| W | 4 | 3.5 | 0 | 1.25 | 0 | 0 |
| Al | 1.7 | 3.5 | 5.5 | 2.5 | 1.4 | 4.4 |
| Ti | 3.4 | 2.5 | 4.7 | 5 | 3 | 3.5 |
| Ta | 0 | 0 | 0 | 0 | 0 | 0 |
| Nb | 0.7 | 3.5 | 0 | 0 | 0 | 0 |
| Fe | 0 | 0 | 0 | 0 | 0 | 0.35 |
| Hf | 0 | 0 | 0 | 0 | 0 | 0 |
| Y | 0 | 0 | 1 | 0 | 0 | 0 |
| Zr | 0.05 | 0.05 | 0.06 | 0.03 | 0.07 | 0 |
| C | 0.05 | 0.07 | 0.18 | 0.04 | 0.07 | 0.06 |
| B | 0.015 | 0.01 | 0.014 | 0.03 | 0.006 | 0.03 |
| Ni | bal. | bal. | bal. | bal. | bal. | bal. |

After providing the Ni-base superalloy, the next step in the method is the step of working the superalloy at preselected working conditions to form the desired article, preferably by forging a preform into a forged article. The preselected working conditions comprise a working temperature less than the γ' solvus temperature, a strain rate greater than a predetermined strain rate, that are sufficient to store a predetermined minimum amount strain energy or retained strain, per unit of volume throughout the superalloy. The worked article should contain strain sufficient to promote subsequent recrystallization of a uniform grain size microstructure throughout the article under appropriate annealing conditions. In general, the strain rate should be greater than 0.03 per second. Reference herein to a "uniform grain size" is intended to describe a microstructure that is not bimodal, and that does not have an ALA grain size that is indicative of critical grain growth (i.e. ≧ASTM 0). In the case of forging, forging is done at a subsolvus temperature with respect to the Ni-base superalloy provided. The subsolvus forging temperature preferably will be in a range 50°–100° F. below the γ' solvus of the superalloy After working the superalloy, it may be necessary to utilize an additional step of subsolvus annealing in order to promote recrystallization and produce the desired fine grain microstructure. In a preferred embodiment, the subsolvus annealing is done at a temperature above the recrystallization temperature, which is generally recognized as being between about 1900°–2000° F. for high γ' content alloys, but below the γ' solvus temperature. Preferably, the subsolvus annealing will be done at a temperature which is about 50° F. to 100° F. below the γ' solvus. Means for subsolvus annealing are well-known. The subsolvus annealing time will depend on the thermal mass of the forged article. The annealing time must be sufficient to recrystallize substantially all of the alloy microstructure in order to form the uniform, fine grain size and avoid critical grain growth. The grain size following subsolvus annealing will depend on many factors, including the grain size of the forging preform, the amount of retained strain, the subsolvus annealing temperature and the composition of the superalloy, particularly the presence of grain boundary pinning phases, such as carbides and carbonitrides.

If a grain size of ASTM 10-12 is the desired grain size, the forged article may be cooled following the subsolvus anneal to ambient temperatures, resulting in the precipitation of γ'. For annealing temperatures that are very near the γ' solvus, some degree of control may be exercised over the distribution of the γ' following subsolvus annealing. For cooling from supersolvus temperatures, the cooling rate should be in the range of 100°–600 F. ° per minute so as to produce both fine γ' particles within the γ grains and γ' within the grain boundaries, as described herein. Cooling at these cooling rates may also make it possible to exercise similar control over the precipitation of γ' where the subsolvus annealing temperature is very close to the γ' solvus, such that a significant portion of the γ' is in solution during the anneal, except that the microstructure will contain some undissolved primary γ'.

In a preferred embodiment, following the step of subsolvus annealing, an additional step of supersolvus heat treatment or annealing is employed for a time sufficient to solutionize at least a portion, and preferably substantially all, of the γ' and cause some coarsening of the recrystallized grain size to about ASTM 5-10 (10–60 μm). Larger grain sizes up to ASTM 5 (60 μm) may be achieved with longer annealing times. The temperature of the anneal is preferably up to about 100 F. ° above the γ' solvus temperature, but in any case below the incipient melting temperature of the superalloy The forged article is typically annealed in the range of about 15 minutes to 5 hours, depending on the thermal mass of the forged article and the time required to ensure that substantially all of the article has been raised to a supersolvus temperature, but longer annealing times are possible. In addition to preparing the forged article for subsequent cooling to control the γ' phase distribution, this anneal is also believed to contribute to the stabilization of the grain size of the forged article. Both subsolvus annealing and supersolvus annealing may be done using known means for annealing Ni-base superalloys.

After supersolvus annealing, the cooling rate of the article may be controlled until the temperature of the entire article is less than the γ' solvus in order to control the distribution of the γ' phase throughout the article. Applicants have determined that in a preferred embodiment, the cooling rate after supersolvus annealing should be in the range of 100°–600° F. per minute so as to produce both fine γ' particles within the γ grains and γ' within the grain boundaries. Typically the cooling is controlled until the temperature of the forged article is about 200°–500° F. less than the solvus temperature, in order to control the distribution of the γ' phase in the manner described above. Faster cooling rates e.g. 600° F. per minute tend to produce a fine distribution of γ' particles within the γ grains. Slower cooling rates e.g. 100° F. per minute tend to produce fewer and coarser γ' particles within the grains, and a greater amount of γ' along the grain boundaries. Various means for performing such controlled cooling are known, such as the use of oil quenching or air jets directed at the locations where cooling control is desired.

It is noted that articles formed using the method of this invention may also be aged sufficiently, using known techniques, to further stabilize the microstructure and promote the development of desirable tensile, creep, stress rupture, low cycle fatigue and fatigue crack growth properties. Means for performing such aging and aging conditions are known to those skilled in the art of forging Ni-base superalloys.

It is also noted that between the steps of working and subsolvus annealing, and subsolvus annealing and supersolvus annealing that the article may be cooled, such as to room temperature, without departing from the method described herein. It is common in forging practice to perform each of these steps discreetly, rather than in a continuous fashion, such that articles will frequently be cooled to room temperature and be reheated therefrom to perform the next process step.

In the course of the work leading to this invention it was found that hot die upset to about 30% reduction at 1900° F. and 0.32 per second strain rate followed by supersolvus heat treatment resulted in bimodal grain size distribution with substantial critical grain growth. When the initial upset is followed by a second isothermal compression to about 70% total reduction at 0.0032 per second and the work piece is then heat treated above the solvus a uniform ASTM 6-8 grain is obtained. The strain accumulated under superplastic conditions was sufficient to recover all the deformation contained in the piece after the first upset.

If the first upset is taken to about 70% and a second compression to total of about 90%, supersolvus heat treatment does not give a uniform ASTM 6-8 but results in bimodal distribution because insufficient strain relaxation by dynamic recovery and recyrstallization is achieved.

Nickel base superalloys like Rene '88 must normally be processed into a microstructure which can be deformed totally superplastically so that after attaining the final shape there is no retained strain energy in the piece and supersolvus heat treatment can be done without any non-uniform grain growth, i.e., critical grain growth. This provides a unimodal grain size distribution. However, it has now been discovered that some amount of non-superplastic deformation can be tolerated, provided subsequent deformation is done superplastically with enough strain being put into the material to erase the retained strain energy remaining after the non superplastic deformation. Accordingly, it is now possible to combine hot die and isothermal processing. The retained strain is believed to be relieved by mechanisms which include either or both dynamic relaxation and recrystallization phenomena.

Illustrative combinations of nonsuperplastic and superplastic deformation processes include:

| FIRST STEP | SECOND STEP |
|---|---|
| 1) hot die upset with temperature gradients and strain rates such that deformation is non-superplastic | isothermal finish at a temperature and strain rate within the superplastic regime |
| 2) upset of hot isostatically pressed materiai, via either hot die forging with gradients and strain rates such that deformation is non-superplastic or even with isothermal forging but with a billet structure that does not have a superplastic processing regime | isothermal finish at a temperature and strain rate within the superplastic regime made possible by the working imparted to the material in the first step |
| 3) upset of sprayformed material via either hot die forging with gradients and strain rates such that deformation is non-superplastic or even with isothermal forging but with a billet structure that does not have a superplastic processing regime that deformation is non-superplastic | isothermal finish at a temperature and strain rate within the superplastic regime made possible by the working imparted to the material in the first step |
| 4) upset of any other billet material either by hot die forging at conditions such that deformation is non-superplastic or even with isothermal forging but with a billet structure that does not have a superplastic processing regime that deformation is non-superplasic | isothermal finish at a temperature and strain rate within the superplastic regime made possible by the working imparted to the material in the first step |
| 5) controlled isothermal forging of billet material capable of being deformed superplasticaily but deformed at strain rates too high to be superplastic | isothermal finish at a temperature and strain rate within the superplastic regime made possible by the working imparted to the material in the first step |

The following examples illustrate the effects on uniformity of grain size distribution and microstructure of various deformation conditions. In all the examples, the samples were given a final heat treatment at 2100° F. for 1 hour and then cooled in air.

EXAMPLE NO. 1

1a) Compression samples deformed at 1900° F., 0.01/sec to 70% upset—bimodal grain size after heat treatment.

1b) Deformed as in "1a" but then deformed again at 1900° F., 0.0032/sec to 15%—uniform grain size after heat treatment.

At 1900° F., the retained strain energy due to 70% reduction in the non-superplastic regime was erased by 15% more reduction in the superplastic regime.

EXAMPLE NO. 2

2a) Double-cone samples deformed at 1850° F., 0.01/sec to 30% upset—bimodal grain size after heat treatment.

2b) Deformed as in "2a" but then deformed again at 1850° F., 0.0032/sec to 50% total upset—still a non-uniform grain size after heat treatment (the additional 20% was insufficient).

2c) Deformed as in "2a" but then deformed again at 1850° F., 0.0032/sec to 80% total upset—uniform grain size after heat treatment (the additional 50% was sufficient).

At 1850° F., the retained strain energy due to a 30% reduction in the non-superplastic regime was erased by 50% more reduction in the superplastic regime but not by only 20% more reduction.

EXAMPLE NO. 3

3a) Double-cone samples deformed at 1925° F., 0.032/sec to 30% upset—bimodal grain size after heat treatment.

3b) Deformed as in "3a" but then deformed again at 1925° F., 0.0032/sec to 50% total upset—uniform grain size after heat treatment (the additional 20% was sufficient).

At 1925° F., the retained strain energy due to a 30% reduction in the non-superplastic regime was erased by 20% more reduction in the superplastic regime.

EXAMPLE NO. 4

4a) Double-cone samples deformed at 1900° F., 0.032/sec to 30% upset—bimodal grain size after heat treatment.

4b) Double-cone samples deformed at 1900° F., 0.032/sec to 70% upset—bimodal grain size after heat treatment.

4c) Deformed as in "4a" but then deformed again at 1900° F., 0.0032/sec to 70% total upset—uniform grain size after heat treatment (the additional 40% was sufficient).

4d) Deformed as in "4b" but then deformed again at 1900° F., 0.0032/sec to 90% total upset—uniform grain size after heat treatment (the additional 20% was sufficient).

At 1900° F., the retained strain energy due to a 30% reduction in the non-superplastic regime was erased by 40% more reduction in the superplastic regime and the retained strain energy due to a 70% reduction in the non-superplastic regime was erased by 20% more reduction in the superplastic regime.

At 1850° F. even for relatively low amounts of non-superplastic deformation (30%), 20% subsequent superplastic reduction was not sufficient but 50% more deformation was effective. At 1900° F. and 1925° F., for both low amounts of non-superplastic deformation (30%) and high amounts of non-superplastic deformation (70%), only about 15 to 20% subsequent superplastic reduction was required. Additional superplastic deformation was possible with no detriment. Overall, this is consistent with an observation that superplasticity is promoted with increasing temperature.

What is claimed is:

1. A method of making Ni-base superalloy articles having a controlled grain size from a forging preform, comprising the steps of:

providing a Ni-base superalloy preform having a recrystallization temperature, a $\gamma'$ solvus temperature and a microstructure comprising a mixture of $\gamma$ and $\gamma'$ phases, wherein the $\gamma'$ phase occupies at least 30% by volume of the Ni-base superalloy;

hot die forging the superalloy perform at a temperature of at least about 1600° F., but below the $\gamma'$ solvus temperature and a strain rate from about 0.03 to about 10 per second to form a hot die forged superalloy work piece;

isothermally forging the hot die forged superalloy work piece to form the finished article;

supersolvus heat treating the finished article to produce a substantially uniform grain microstructure of about ASTM 6-8;

cooling the article from the supersolvus heat treatment temperature.

2. The method of claim 1, wherein the superalloy preform comprises an extruded billet formed by hot-extruding a pre-alloyed Ni-base superalloy powder.

3. The method of claim 1, wherein the superalloy composition comprises 8–15 Co, 10–19.5 Cr, 3–5.25 Mo, 0–4 W, 1.4–5.5 Al, 2.5–5 Ti, 0–3.5 Nb, 0–3.5 Fe, 0–1 Y, 0–0.07 Zr, 0.04–0.18 C, 0.006–0.03 B and a balance of Ni, in weight percent, excepting incidental impurities.

4. The method of claim 1, wherein the strain rate is about 1 per second.

5. The method of claim 1, wherein the hot die forging temperature is at least about 100° F. below the solvus temperature.

6. The method of claim 1, further comprising subsolvus annealing after one of the hot die forging and the isothermal forging, recrystallization of the Ni-base superalloy occurring during the subsolvus annealing, wherein the article has a uniform grain size after recrystallization of about 10 μm or smaller.

7. The method of claim 6, wherein the subsolvus heat treating is ≦ about 100° F. below the solvus temperature.

8. A method of making a Ni-base superalloy article having a controlled grain size from a forging preform, comprising the steps of:

providing a Ni-base superalloy preform having a recrystallization temperature, a $\gamma'$ solvus temperature and a microstructure comprising a mixture of $\gamma$ and $\gamma'$ phases, wherein the $\gamma'$ phase occupies at least 30% by volume of the Ni-base superalloy;

hot die forging the superalloy preform at a temperature between about 1600° F. and about 1950° F. and a strain rate between about 0.03 and 10 per second to form a hot die forged superalloy;

isothermally forging the hot die forged superalloy at a temperature of about 1925° F. and a strain rate of about 0.0032 per second to form a finished article;

supersolvus heat treating the finished to produce a substantially uniform grain microstructure of about ASTM 6–8;

subsolvus annealing the article at a subsolvus temperature for a time sufficient to cause recrystallization of a uniform grain size throughout the article; and supersolvus annealing the article at a supersolvus temperature for a time sufficient to cause the dissolution of at least a portion of the $\gamma'$ and the coarsening of the recrystallized grain size to a larger solutionized grain size.

9. The method of claim 8, wherein the superalloy preform comprises an extruded billet formed by hot-extruding a pre-alloyed Ni-base superalloy powder.

10. The method of claim 8, wherein the superalloy comprises 8–15 Co, 10–19.5 Cr, 3–5.25 Mo, 0–4 W, 1.4–5.5 Al, 2.5–5 Ti, 0–3.5 Nb, 0–3.5 Fe, 0–1 Y, 0–0.07 Zr, 0.04–0.18 C, 0.006–0.03 B and a balance of Ni, in weight percent, excepting incidental impurities.

11. The method of claim 8, wherein the hot die forging temperature is ≦ about 600° F. below the solvus temperature.

12. The method of claim 8, wherein the subsolvus annealing temperature is ≦ about 100° F. below the solvus temperature.

13. The method of claim 8, wherein the supersolvus heat treatment temperature is ≦ about 100° F. above the solvus temperature.

14. The method of claim 8, further comprising a step of cooling the article from one of the subsolvus annealing and the supersolvus annealing, wherein the step of cooling is done at a rate in the range between about 100° to about 600° F./minute.

15. The method of claim 8, further comprising the step of aging the article at a temperature and for a time sufficient to provide a stabilized microstructure in the article that is useful for operation at temperatures up to about 1400° F.

* * * * *